US009713218B2

(12) United States Patent
Zhou et al.

(10) Patent No.: US 9,713,218 B2
(45) Date of Patent: Jul. 18, 2017

(54) DIMMING CONTROL CIRCUIT AND DIMMING CONTROL METHOD THEREOF

(71) Applicant: ASUSTek COMPUTER INC., Taipei (TW)

(72) Inventors: Xiao-Feng Zhou, Taipei (TW); Ching-Ji Liang, Taipei (TW)

(73) Assignee: ASUTeK COMPUTER INC., Taipei (TW)

( * ) Notice: Subject to any disclaimer, the term of this patent is extended or adjusted under 35 U.S.C. 154(b) by 0 days.

(21) Appl. No.: 15/343,228

(22) Filed: Nov. 4, 2016

(65) Prior Publication Data

US 2017/0156185 A1 Jun. 1, 2017

(30) Foreign Application Priority Data

Nov. 26, 2015 (CN) ..... 2015 1 0843118

(51) Int. Cl.
*G05F 1/00* (2006.01)
*H05B 33/08* (2006.01)

(52) U.S. Cl.
CPC ..... *H05B 33/0845* (2013.01)

(58) Field of Classification Search
CPC ..... H05B 33/0803; H05B 33/0827; H05B 33/0809; H05B 33/0821; H05B 33/0815; H05B 33/0818; H05B 41/2828; H05B 41/3921; H05B 41/3927; H05B 37/029; H05B 37/0254; H05B 37/02; F21Y 2101/02
See application file for complete search history.

(56) References Cited

U.S. PATENT DOCUMENTS 8,008,953 B1 * 8/2011 Brumett, Jr. ..... H03K 17/166 327/109
8,884,866 B2 11/2014 Chen et al.
2008/0133802 A1 6/2008 Nagamine
2009/0307381 A1 12/2009 Croyle et al.
2013/0127924 A1 5/2013 Lee

* cited by examiner

*Primary Examiner* — Minh D A
(74) *Attorney, Agent, or Firm* — CKC & Partners Co., Ltd.

(57) ABSTRACT

A dimming control circuit for adjusting brightness of a light-emitting component is provided. The dimming control circuit includes a driving transistor, an amplifier and a control circuit. The driving transistor is coupled to the light-emitting component The amplifier includes a first input terminal and an output terminal. The output terminal is coupled to a gate of the driving transistor. The control circuit is coupled to the amplifier. The control circuit generates a second analog signal to the first input terminal of the amplifier according to a first analog signal. A slew rate of the second analog signal below the slew rate of the first analog signal and the amplifier controls the driving transistor to adjust a driving current flowing through the light-emitting component according to the second analog signal.

14 Claims, 6 Drawing Sheets

DIMMING CONTROL CIRCUIT AND DIMMING CONTROL METHOD THEREOF

CROSS-REFERENCE TO RELATED APPLICATION

This application claims the priority benefit of China application serial No. 201510843118.5, filed on Nov. 26, 2015. The entirety of the above-mentioned patent application is hereby incorporated by references herein and made a part of specification.

BACKGROUND OF THE INVENTION

Field of the Invention

The disclosure relates to an electronic device and, more specifically to, a dimming control circuit of an electronic deuce and a dimming control method thereof.

Description of the Related Art

In general consumer electronics, such as smart phones and tablet computers, usually have a screen to display diversified man-machine interactions. Generally, the consumer electronics can adjust screen brightness automatically according to the change of the ambient brightness. However, the brightness of the backlight of the screen is changed stepwise. During the automatic dimming control, a screen flicker may occur when the ambient brightness changes violently.

BRIEF SUMMARY OF THE INVENTION

According to a first aspect, a dimming control circuit for adjusting brightness of a light-emitting component is provided. The dimming control circuit includes a driving transistor, an amplifier and a control circuit. The driving transistor is coupled to the light-emitting component. The amplifier includes a first input terminal and an output terminal. The output terminal is coupled to a gate of the driving transistor. The control circuit is coupled to the amplifier. The control circuit generates a second analog signal to the first input terminal of the amplifier according to a first analog signal. A slew rate of the second analog signal is below the slew rate of the first analog signal and the amplifier controls the driving transistor to adjust a driving current flowing through the light-emitting component according to the second analog signal.

According to a second aspect, a dimming control circuit for adjusting brightness of a light-emitting component is provided. The dimming control circuit comprises a driving transistor, an amplifier and a control circuit. The driving transistor is coupled to the light-emitting component. The amplifier includes an output terminal. The control circuit is coupled between the output terminal of the amplifier and a gate of the driving transistor. The output terminal of the amplifier generates a first dimming control signal, the control circuit reduces a slew rate of the first dimming control signal and outputs a second dimming control signal to the gate of the driving transistor.

According to a third aspect, a dimming control method is provided. The dimming control method is adapted to a dimming control circuit. The dimming control circuit includes a control circuit and a driving transistor. The dimming control method comprising: reducing a slew rate of a first analog signal by the control circuit to generate a second analog signal and controlling the driving transistor to adjust a driving current flowing through a light-emitting component according to the second analog signal.

In sum, the dimming control circuit and the dimming control method are provided to adjust the brightness of the light-emitting component according to the current ambient brightness and the received dimming signal. Thus, the brightness changes of the light-emitting diode (LED) would not too violent and the screen flicker is reduced.

BRIEF DESCRIPTION OF THE DRAWINGS

These and other features, aspects and advantages of the disclosure will become better understood with regard to the following embodiments and accompanying drawings.

DETAILED DESCRIPTION OF THE EMBODIMENTS

Embodiments are described hereinafter accompanying with drawings, which are not used for limiting the scope of the present disclosure. Operations described in embodiments of the present disclosure do not limit to the sequence of steps in embodiments. The configuration of the structure in embodiments can be various to perform the same functionality. The drawings are only for illustration, in which the components are not represented in their actual size. For better understanding, same or similar reference number denotes same or similar components hereinafter.

Figure 1:
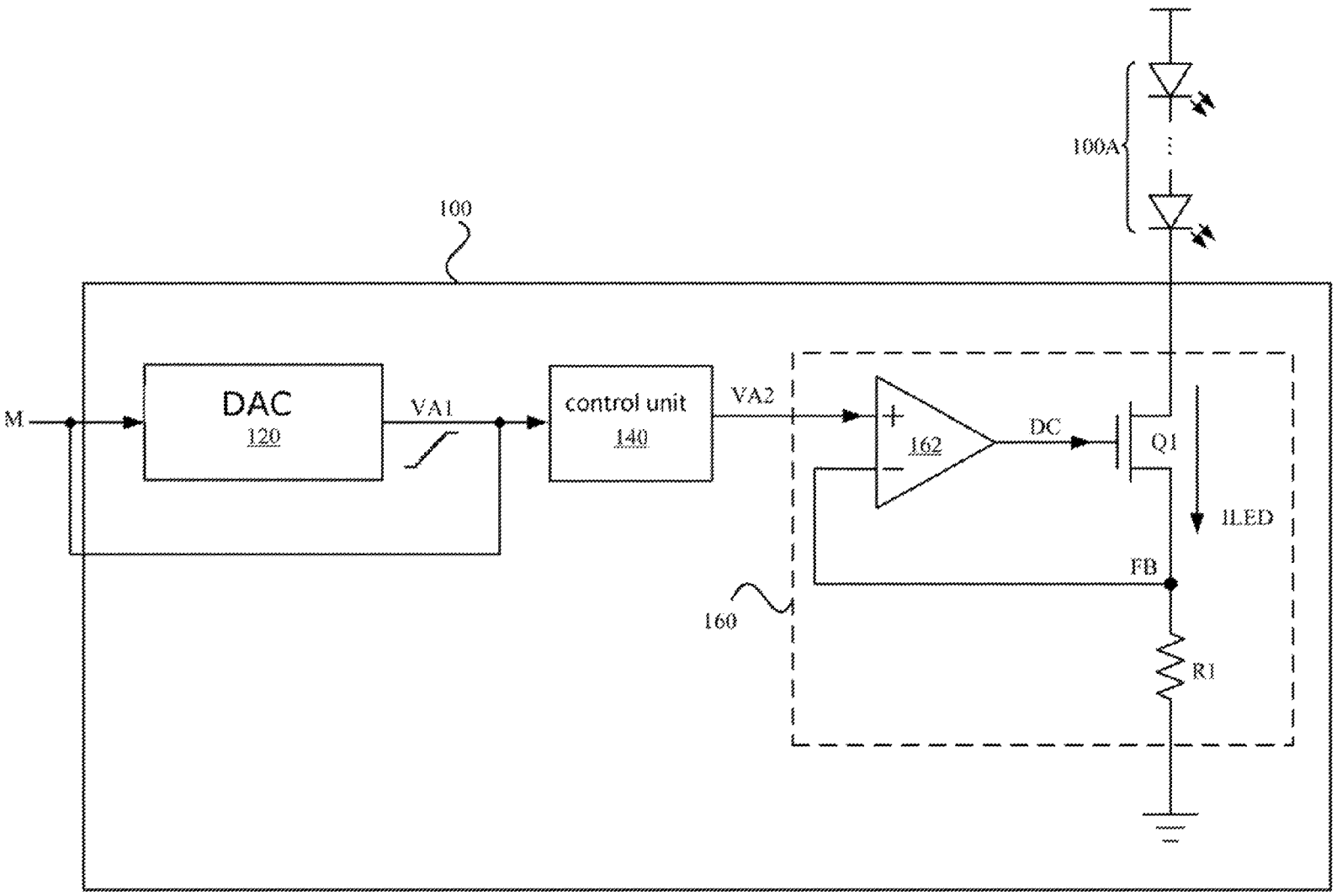
FIG. 1 is a schematic diagram showing a dimming control circuit in an embodiment.

FIG. 1 is a schematic diagram showing a dimming control circuit in an embodiment. As shown in FIG. 1, a dimming control circuit 100 adjusts brightness of at least one light-emitting component. In the embodiment, the light-emitting component may be a LED or a screen backlight of an electronic device.

In the embodiment, the dimming control circuit 100 includes a digital-to-analog converter (DAC) 120, a control circuit 140 and a driving circuit 160. The DAC 120 receives a dimming signal VDIMM and generates a corresponding first analog signal VA1 according to the dimming signal VDIMM. The control circuit 140 is coupled between the DAC 120 and the driving circuit 160. The control circuit 140 adjusts the slew rate of the analog signal VA1 and outputs the adjusted first analog signal VA1 (called as a second analog signal VA2 hereinafter).

In an embodiment, the dimming signal VDIMM is a pulse-width modulation (PWM) signal. In the embodiment, the dimming signal VDIMM is transmitted to the driving circuit 160 to operate dimming control. In an embodiment, the dimming signal VDIMM is a digital control signal provided by an inter-integrated circuit (I2C) interface. The dimming signal VDIMM is converted to the first analog signal VA1 by the DAC 120, and then the first analog signal VA1 is transmitted to the driving circuit 160 to operate dimming control. The first analog signal VA1 includes a plurality of step voltages that are changed continuously. The slew rate of the analog signal VA1 is adjusted by the control circuit 140 to make the slope of the step voltages smooth. In such a way, the driving circuit 160 is capable of adjusting the brightness of the light-emitting component gradually. Consequently, the brightness of the light-emitting component 100A is adjusted evenly to reduce the screen flicker.

In an embodiment, the light-emitting component 100A includes one or more LEDs. The driving circuit 160 is coupled to the light-emitting component 100A, to control a current ILED flowing through the light-emitting component 100A and then to, adjust the brightness of the light-emitting component 100A. The driving circuit 160 includes an amplifier 162, a switch Q1 and a resistor R1. The amplifier 162 generates a first dimming control signal DC according to the second analog signal VA2 and a feedback signal FB. In an embodiment, the switch Q1 is a driving transistor. The driving transistor controls the current ILED flowing through at least one of the light-emitting components 100A according to the first dimming control signal DC received by the gate. In an embodiment the driving transistor is an analog switch. The resistor R1 generates the feedback signal FB according to the current ILED. The current ILED is changed with the dimming signal VDIMM and thus the brightness of the light-emitting component 100A is adjusted.

A first input terminal of the amplifier 162 is coupled to the control circuit 140 to receive the second analog signal VA2. A second input terminal of the amplifier 162 receives the feedback signal FB. An output terminal of the amplifier 162 outputs the first dimming control signal DC. A first terminal of the switch Q1 is coupled to at least one of the light-emitting components. A second terminal of the switch Q1 is coupled to a first terminal of the resistor R1. A control terminal of the switch Q1 is coupled to the output terminal of the amplifier 162 to receive the second analog signal VA2. The first terminal of the resistor R1 is coupled to the second input terminal of the amplifier 162 to generate the feedback signal FB. A second terminal of the resistor R1 is coupled to the ground.

Figure 2A:
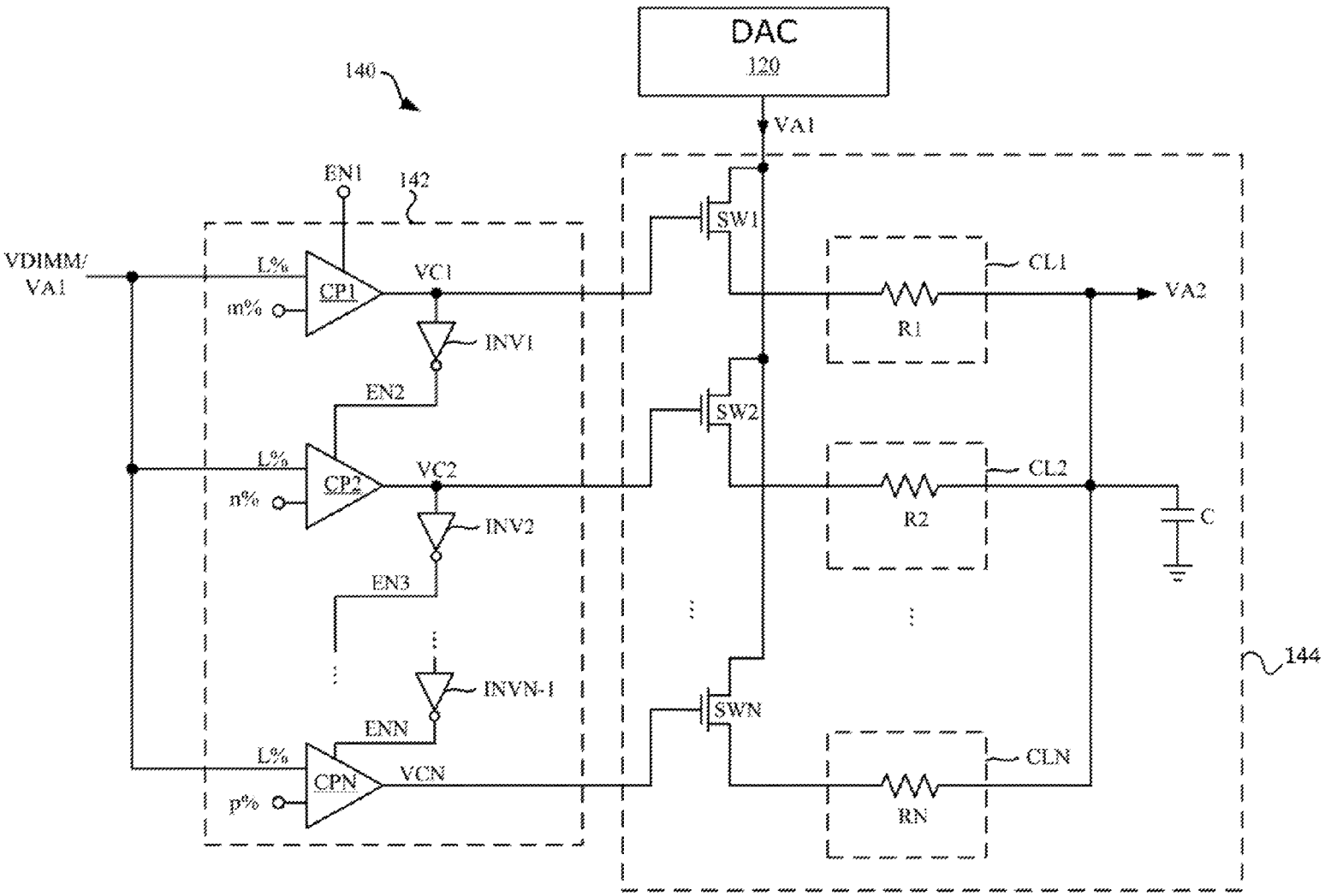
FIG. 2A is a schematic diagram showing a control circuit in an embodiment.

FIG. 2A is a schematic diagram showing a control circuit in an embodiment. In embodiments, with the great change of the dimming signal VDIMM, the screen brightness of the electronic device changes greatly. In the embodiment, the screen brightness of the electronic device is represented in percentage. For example, with different screen brightness, the dimming signal VDIMM or the first analog signal VA1 is adjusted to different levels. The maximum screen brightness of the electronic device is 100% and corresponds to a level of the dimming signal VDIMM or the first analog, signal VA1. On the other hand, the minimum screen brightness of the electronic device is 0% and corresponds to another level of the dimming signal VDIMM or the first analog signal VA1. In the embodiment, the control circuit 140 determines the brightness difference L% according to the dimming signal VDIMM or the first analog signal VA1 and compares the brightness difference L% with a threshold value m%, a threshold value n%, . . . , and a threshold value p%, respectively, to adjust the slew time of the first analog signal VA1 and then output the corresponding second analog signal VA2. In the embodiment, the brightness difference L% is a difference between the target brightness and the current screen brightness, and m, n, p and N are a positive number. In such a way, the control circuit 140 changes the slew time, but not a fixed slew time, according to the variations of the screen brightness to adjust the slew rate of the first analog signal VA1 adaptively.

As shown in FIG. 2A, compared with the control circuit 140 in FIG. 1, the control circuit 140 includes a slew rate selecting circuit 142 and an adjusting circuit 144. The slew rate selecting circuit 142 compares the brightness difference L% with the threshold value m% to generate a control signal VC1. When the brightness difference L% is less than the threshold value m%, the slew rate selecting circuit 142 continues to compare the brightness difference L% with the threshold value n% to generate a control signal VC2. Similarly, the slew rate selecting circuit 142 compares the brightness difference L% with the threshold value m%, the threshold value n%, . . . , and the threshold value p% respectively to output multiple corresponding control signals VC1~VCN. In the embodiment, the threshold value m% is greater than the threshold value n%, and the threshold value n% is greater than the threshold value p%.

The adjusting circuit 144 determines the slew time of the first analog signal VA1 according to the control signals VC1~VCN and then adjusts the first analog signal VA1 to output the second analog signal VA2. In an embodiment, the slew rate selecting circuit 142 determines the brightness difference L% according to the dimming signal VDIMM provided by an external device (such as an I2C interface) directly. In another embodiment, the slew rate selecting circuit 142 calculates the brightness difference L% according to the first analog signal VA1. In an embodiment, the slew rate selecting circuit 142 includes a plurality of comparators CP1~CPN and a plurality of inverters INV1~INVN-1. The comparator CP1 is enabled according to an initial enable signal EN1 and compares the brightness difference L% with the threshold value m% to generate the control signal VC1. The inverter INV1 is coupled to an output terminal of the comparator CP1 to generate an enable signal EN2 according to the control signal VC1. That is, the state of the control signal VC1 and the enable signal EN2 are inverse.

The comparator CP2 is enabled according to the enable signal EN2 and compares the brightness difference L% with the threshold value n% to generate the control signal VC2. The inverter INV2 is coupled to an output terminal of the comparator CP2 to generate an enable signal EN3 according the control signal VC2. The control signal VC2 and the, enable signal EN3 are converse, Similarly, the inverters INV1~INM generate the enable signals EN2~ENN according to the control signals VC1~VCN to enable the comparators CP2~CPN in order. In such a way, the comparators CP1~CPN are selectively enabled according to the comparing result of the former comparator to compare the brightness difference with the corresponding threshold value. In an embodiment, the dimming control circuit 100 provides the initial enable signal EN1 to enable the first comparator CP1 when the dimming signal VDIMM varies.

In the embodiment, the adjusting circuit 144 includes a plurality of switches SW1~SWN, a plurality of current limiting elements CL1~CLN and a capacitor C. Each of the switches SW1~SWN is coupled to the corresponding one of the comparators CP1~CPN and is turned on according to the one of the control signals VC1~VCN correspondingly to provide the first analog signal VA1 generated by the DAC 120 to a first terminal of the one of the current limiting elements CL1~CLN correspondingly. Second terminals of the current limiting elements CL1~CLN are coupled to a first terminal of the capacitor C to output the second analog signal VA2. A second terminal of the capacitor C is coupled to the ground.

In an embodiment, the switch SW1 and the current limiting element CL1 are taken for example, a first terminal of the switch SW1 is coupled to the output terminal of the DAC 120 to receive the first analog signal VA1, a second terminal of the switch SW1 is coupled to a first terminal of the current limiting element CL1, a control terminal of the switch SW1 is coupled to the output terminal of the comparator CP1 and the input terminal of the inverter INV1 to receive the control signal VC1.

In an embodiment, the current limiting elements CL1~CLN are resistors R1~RN. The resistor R1 is taken for example, a first terminal of the resistor R1 is coupled to the second terminal of the switch SW1 to receive the first analog signal VA1. A second terminal of the resistor R1 is coupled to the second terminal of the capacitor C to output the control signal VC1. The configuration of the other resistors R2~RN can refer to the resistor R1.

In an embodiment, the values of the resistors R1~RN are decreased gradually. That is, the resistors R1~RN and the capacitor C correspond to different slew times respectively. In an embodiment, the resistor R1 has a maximum resistance value, the resistor R1 and the capacitor C correspond to the maximum slew time. Therefore, when the brightness difference is large (for example, the brightness difference L% is greater than m%), the switch SW1 is turned on, and the slew rate of the first analog signal VA1 is adjusted via the resistor R1 and the capacitor C. In such a way, the slew time of the step voltages of the first analog signal VA1 is adjusted through an adjustment path with the maximum slew time (i.e., through the resistor R1 and the capacitor C).

Figure 2B:
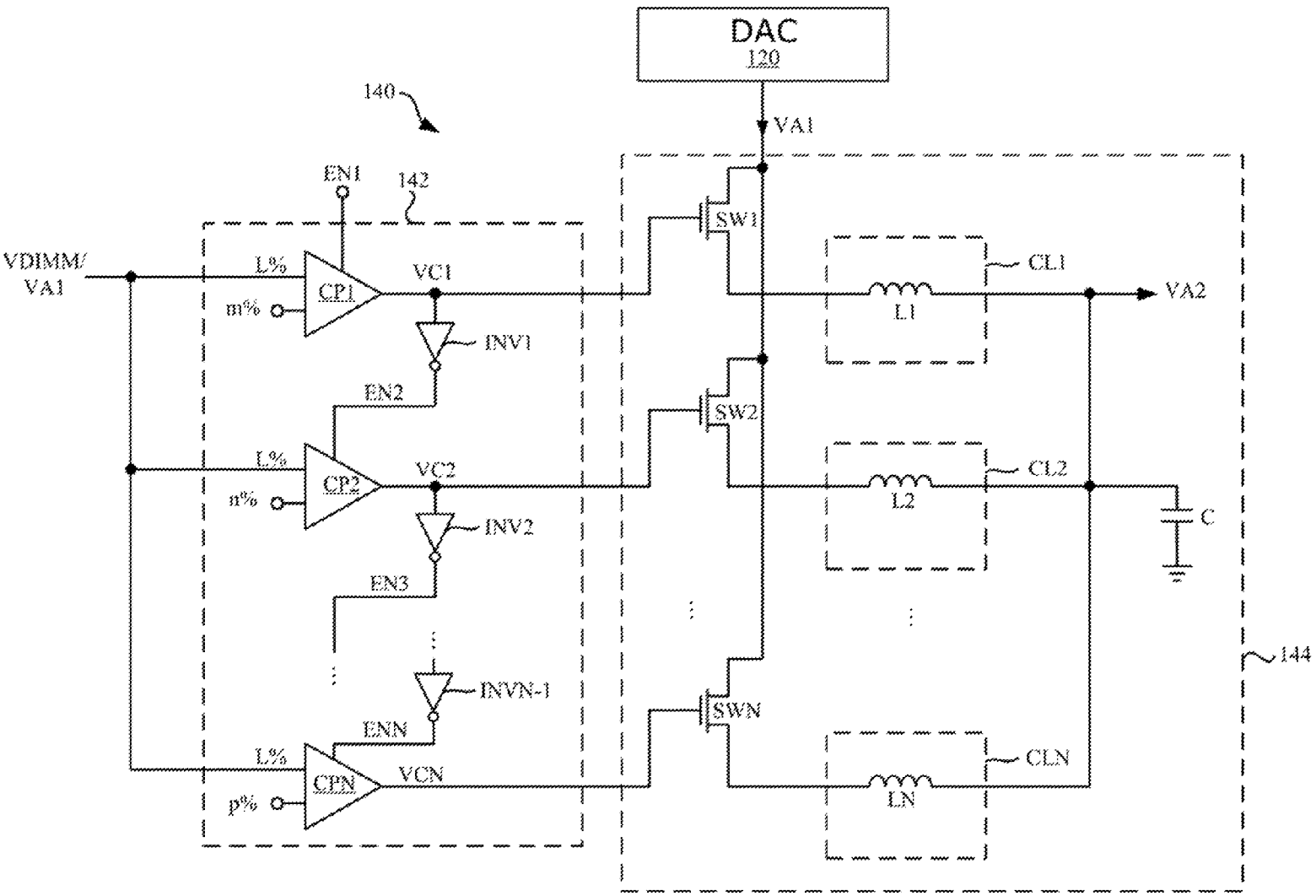
FIG. 2B is a schematic diagram showing a control circuit in an embodiment.

FIG. 2B is a schematic diagram showing a control circuit in an embodiment. As shown in FIG. 2B, in the embodiment, the current limiting elements CL1~CLN are inductors L1~LN. A first terminal of the inductor L1 is coupled to the second terminal of the switch SW1 to receive the first analog signal VA1. A second terminal of the inductor L1 is coupled to the second terminal of the capacitor C to output the control signal VC1. The configuration of the inductors L2~LN can refer to the inductor L1.

The control circuit 140 and the current limiting element 142 are exemplified only for illustration, which is not limited herein. Other circuits for adjusting the slew rate are also within the scope of the disclosure.

Figure 3:
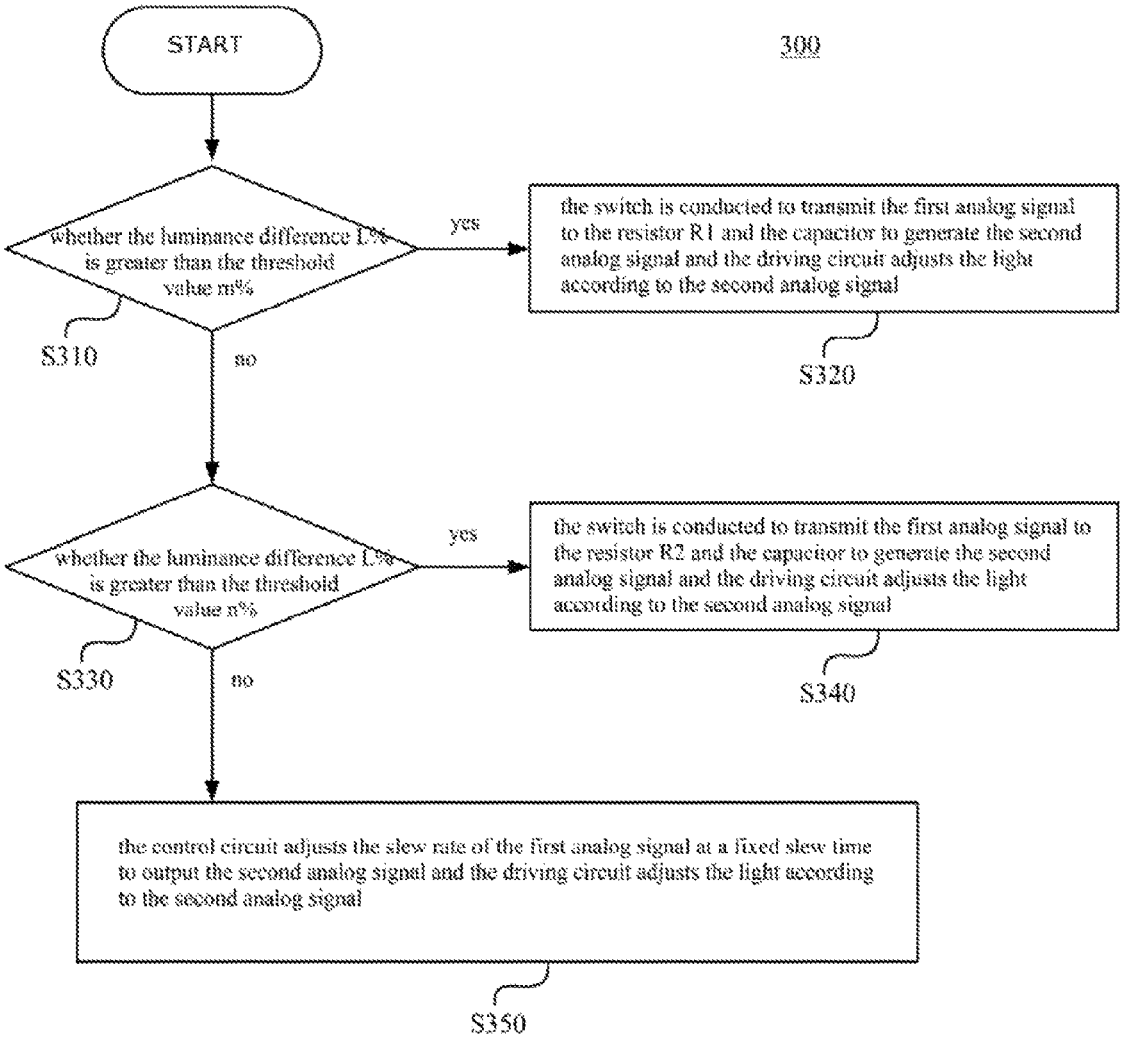
FIG. 3 is a flowchart of a dimming control method in an embodiment.

FIG. 3 is a flowchart of a dimming control method in an embodiment. Referring to FIG. 1, FIG. 2A and FIG. 3, a dimming control method 300 is described cooperating with the operations of the dimming control circuit 100 and the control circuit 140. In the embodiment, the control circuit 140 includes two comparators CP1~CP2 and two current limiting elements CL1~CL2. In another embodiment, the control circuit 140 includes, but not limited to, multiple comparators CP1~CPN and multiple current limiting elements CL1~CLN.

As shown in FIG. 3, the dimming control method includes step S310, step S320, step S330, step S340 and step S350. In step S310, the comparator CP1 compares whether the brightness difference L% is greater than the threshold value m%. If the brightness difference L% is greater than the threshold value m%, step S320 is executed. If the brightness difference L% is less than the threshold value m%, step S330 is executed.

In step S320, the switch SW1 is turned on to transmit the first analog signal VA1 to the resistor R1 and the capacitor C to generate the second analog signal VA2. The driving circuit 160 then adjusts the brightness according to the second analog signal VA2. For example, the brightness difference L% is 50% and the threshold value m% is 30%. Since the brightness difference L% is greater than the threshold value m%, after the comparator CP1 compares the brightness difference L% with the threshold value m%, a control signal RC1 of a high level is output to conduct the switch SW1. Accordingly, the conduction of the switch SW1 allows the resistor R1 and the capacitor C to adjust the first analog signal VA1 to output the second analog signal VA2. The driving circuit 160 then adjusts the brightness of at least one of the light-emitting components 100A according to the second analog signal VA2. Meanwhile, the inverter INV1 outputs an enable signal EN2 of a low level to disable the comparator CP2. Thus, the subsequent comparators CP2~CPN and the switches SW2~SWN are disabled.

In step S330, the comparator CP2 is enabled by the enable signal EN2 to compare whether the brightness difference L% is greater than the threshold value n%. If the brightness difference L% is greater than the threshold value n%, step S340 is executed. If the brightness difference L% is less than the threshold value n%, step S350 is executed.

In step S340, the switch SW2 is turned on to transmit the first analog signal VA1 to the resistor R2 and the capacitor C to generate the second analog signal VA2. The driving circuit 160 adjusts the brightness according to the second analog signal VA2, For example, the brightness difference L% is 25%, the threshold value m% is 30%. and the threshold value n% is 20%. Since the brightness difference L% is less than the threshold value m%, after the comparator CP1 compares the brightness difference L% with the threshold value m%, a control signal VC1 of a low level is output and the switch SW1 is turned off Accordingly, the inverter INV1 outputs an enable signal EN2 of a high level and the comparator CP2 is enabled. Since the brightness difference L% is greater than the threshold value n%, after the comparator CP2 compares the brightness difference L% with the threshold value n%, a control signal VC2 of a high level is output and the switch SW2 is turned on to allow the resistor R2 and the capacitor C to adjust the first analog signal VA1 and outputs the second analog signal VA2. The driving circuit 160 adjusts the brightness of at least one of the light-emitting components 100A according to the second analog signal VA2.

In step S350, the control circuit 140 adjusts the slew rate of the first analog signal VA1 at a fixed slew time to output the second analog signal VA2. The driving circuit 160 adjusts the brightness according to the second analog signal VA2. After the comparisons via the comparators CP1~CPN are completed, if the brightness difference L% is not greater than any of the threshold values, that means, the target brightness according to the dimming signal VDIMM is not different greatly from the current brightness, so the control circuit 140 adjusts the slew rate of the first analog signal VA1 at the fixed slew time.

Figure 4A:
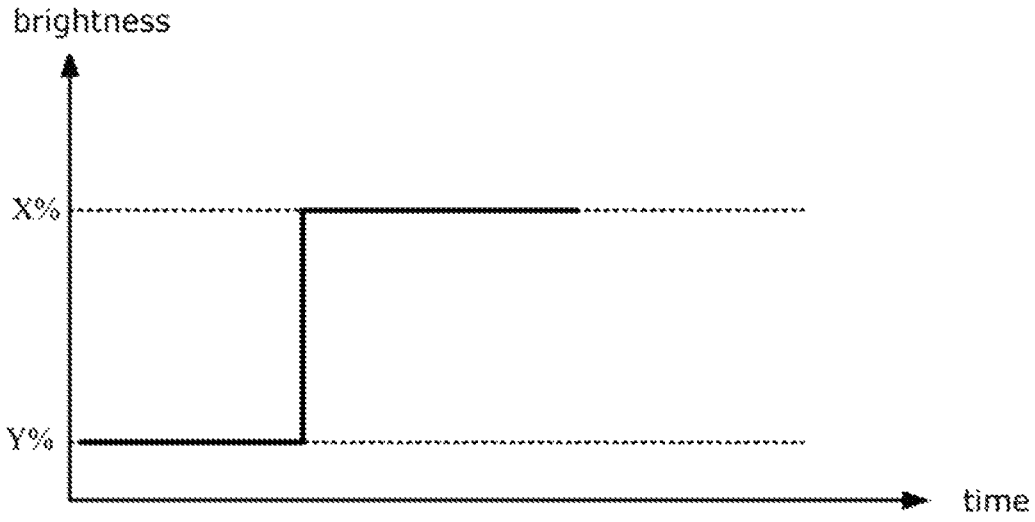
FIG. 4A is a schematic diagram showing brightness changes of a LED when a slew rate of an analog signal is not adjusted in a conventional method.
Figure 4B:
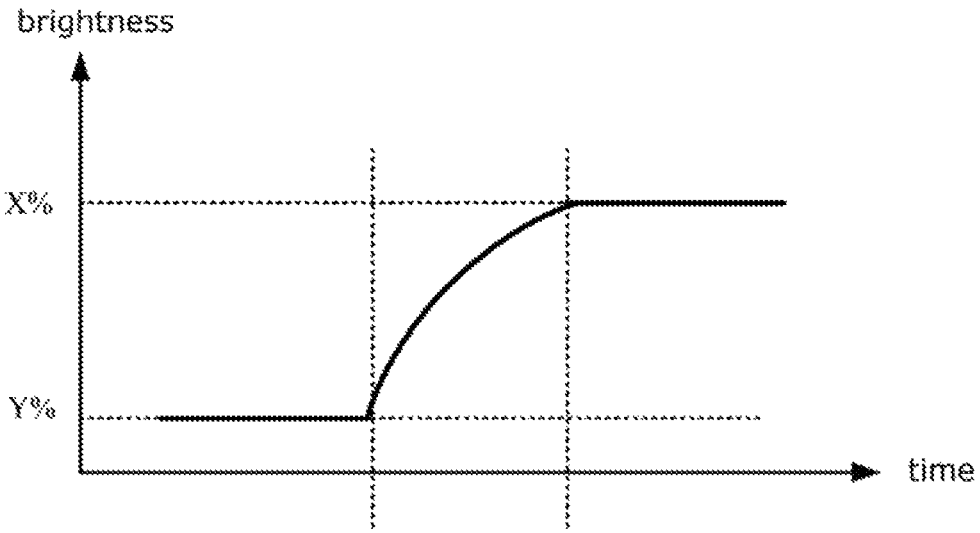
FIG. 4B is a schematic diagram showing brightness changes of a LED in an embodiment.

FIG. 4A is a schematic diagram showing brightness changes of a LED when a slew rate of an analog signal is not adjusted in a conventional method. FIG. 4B is a schematic diagram showing brightness changes of a LED in an embodiment.

As shown in FIG. 4A, conventionally, if the brightness of the light-emitting component 100A is directly raised from Y% to X%, a screen flicker occurs due to the great changes of the screen brightness. In contrast, as shown in FIG. 4B, with the control circuit 140, the first analog signal VA1 is changed gradually and then the current ILED is adjusted by the switch Q1 smoothly, Then, the brightness of the light-emitting component 100A is changed from Y% yap to X% gradually. As a result, the screen flicker is reduced due to the gradual changes of the screen brightness.

The control circuit 140 in the embodiments is configured to adjust the slew rate of the first analog signal VA1.

However, any other control circuit 140 for slowing the changes of current ILED fall within the scope of the disclosure, which is not limited herein.

Figure 5:
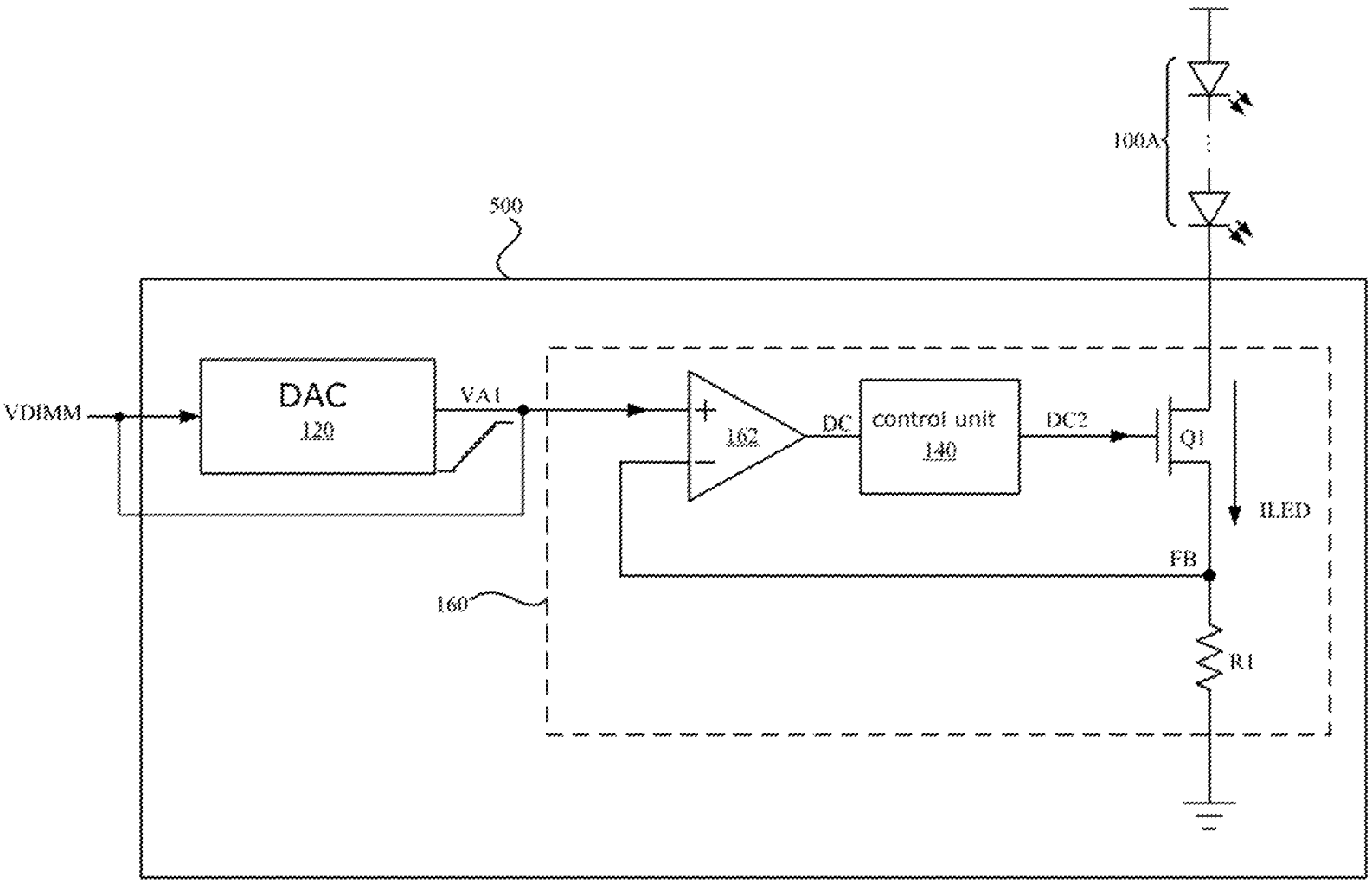
FIG. 5 is a schematic diagram showing a dimming control circuit in an embodiment.

FIG. 5 is a schematic diagram showing a dimming control circuit 500 in an embodiment. For example, compared with the dimming control circuit 100 in FIG. 1, the control circuit 140 of the dimming control circuit 500 is configured between the output terminal of the amplifier 162 and the control terminal of the switch Q1 to reduce the slew rate of the first dimming control signal DC and output a second dimming control signal DC2. In the embodiment, the switch Q1 adjusts the current ILED according to the second dimming control signal DC2. In the embodiment, the amplifier 162 is configured to generate the first dimming control signal DC to the control circuit 140 according to the first analog signal VA1 and the feedback signal FB.

In the embodiment, the first terminals of the switches SW1~SWN in FIG. 2A are coupled to the output terminal of the amplifier 162 to receive the first dimming control signal DC. The second terminals of the current limiting elements CL1~CLN output the second dimming control signal DC2. The configuration and operation of the control circuit 140 are similar to those of the control circuit 140 in the above embodiments, the description of which is omitted herein.

The control circuit 140 selectively adjusts the slew rate of the analog signal VA1 or the first dimming control signals DC to avoid that instant brightness of the light-emitting component 100A changes greatly according to the dimming signal VDIMM.

Although the disclosure has been disclosed with reference to certain embodiments thereof, the disclosure is not for limiting the scope. Persons having ordinary skill in the art may make various modifications and changes without departing from the scope of the disclosure. Therefore, the scope of the appended claims should not be limited to the description of the embodiments described above.

What is claimed is:

1. A dimming control circuit for adjusting brightness of a light-emitting component, comprising:

a driving transistor coupled to the light-emitting component;

an amplifier including a first input terminal and an output terminal, wherein the output terminal is coupled to a gate of the driving transistor; and a control circuit coupled to the amplifier, configured to generate a second analog signal to the first input terminal of the amplifier according to a first analog signal, wherein a slew rate of the second analog signal is below the slew rate of the first analog signal, and the amplifier controls the driving transistor to adjust, a driving current flowing through the light-emitting component according to the second analog signal.

2. The dimming control circuit according to claim 1, further comprising:

a digital-to-analog converter configured to receive a dimming signal and output the first analog signal to the control circuit.

3. The dimming control circuit according to claim 2, wherein the control circuit comprises:

a first comparator including:

a first input terminal configured to receive the first analog signal or the dimming signal;

a second input terminal configured to receive a first threshold value; and an output terminal configured to output a first control signal; and a second comparator including:

a first input terminal configured to receive the first analog signal or the dimming signal;

a second input terminal configured to receive a second threshold value; and an output terminal configured to output a second control signal.

4. The dimming control circuit according to claim 3, wherein the first comparator is enabled according to an initial enable signal to output the first control signal, the control circuit further comprises:

an inverter including:

an input terminal coupled to the output terminal of the first comparator, configured to receive the first control signal; and an output terminal configured to output the enable signal to the second comparator to enable the second comparator to output the second control signal.

5. The dimming control circuit according to claim 3, wherein the control circuit further comprises:

a first switch including a control terminal coupled to the output terminal of the first comparator to receive the first control signal, and a first terminal coupled to the digital-to-analog converter to receive the first analog signal;

a second switch including a control terminal coupled to the output terminal of the second comparator to receive the second control signal, and a first terminal coupled to the digital-to-analog converter to receive the first analog signal;

a first current limiting element including a first terminal coupled to a second terminal of the first switch;

a second current limiting element including a first terminal coupled to a second terminal of the switch; and a capacitor coupled to a second terminal of the first current limiting element and a second terminal of the second current limiting element, configured to output the second analog signal to the first input terminal of the amplifier.

6. The dimming control circuit according to claim 5, wherein the current limiting element includes at least one resistor or at least one inductor.

7. The dimming control circuit according to claim 1, wherein the amplifier further includes a second input terminal, the dimming control circuit further comprises:

a resistor coupled between the driving transistor and a ground, configured to generate a feedback signal to the second input terminal of the amplifier according to the driving current.

8. A dimming control circuit for adjusting brightness of a light-emitting component, comprising:

a driving transistor coupled to the light-emitting component;

an amplifier including an output terminal; and a control circuit coupled between the output terminal of the amplifier and a gate of the driving transistor, wherein the output terminal of the amplifier generates a first dimming control signal, the control circuit reduces a slew rate of the first dimming control signal and outputs a second dimming control signal to the gate of the driving transistor.

9. The dimming control circuit according to claim g the control circuit further comprising:

a first comparator including:

a first input terminal configured to receive the first dimming control signal;

a second input terminal configured to receive a first threshold value; and an output terminal configured to output a first control signal; and a second comparator including:

a first input terminal configured to receive the first dimming control signal;

a second input terminal configured to receive a second threshold value; and an output terminal configured to output a second control.

10. The dimming control circuit according to claim 9, wherein the first comparator is enabled according to an initial enable signal to output the first control signal, the control circuit further comprises:

an inverter including:

an input terminal coupled to the output terminal of the first comparator configured to receive the first control signal; and an output terminal configured to output the enable signal to the second comparator to enable the second comparator to output the second control signal.

11. The dimming control circuit according to claim 9, wherein the control circuit further comprises:

a first switch including a control terminal coupled to the output terminal of the first comparator configured to receive the first control signal, and a first terminal coupled to the output terminal of the amplifier configured to receive the first analog signal;

a second switch including a control terminal coupled to the output terminal of the second comparator configured to receive the second control signal, and a first terminal coupled to the output terminal of the amplifier configured to receive the first analog signal;

a first current limiting element including a first terminal coupled to a second terminal of the first switch;

a second current limiting element including a first terminal coupled to a second terminal of the second switch; and a capacitor coupled to a second terminal of the first current limiting element and a second terminal of the second current limiting element.

12. A dimming control method adapted to a dimming control circuit, the dimming control circuit including a control circuit and a driving transistor, the dimming control method comprising:

reducing a slew rate of a first analog signal by the control circuit to generate a second analog signal; and controlling the driving transistor to adjust a driving current flowing through a light-emitting component according to the second analog signal.

13. The dimming control method according to claim 12, further comprising:

determining a brightness difference by the control circuit according to the first analog signal; and reducing the slew rate of the first analog signal by a first slew time to generate the second analog signal when the brightness difference is greater than a first threshold value.

14. The dimming control method according to claim 13, further comprising:

comparing the brightness difference with a second threshold value when the brightness difference is less than the first threshold value;

reducing the slew rate of the first analog signal by a second slew time to generate the second analog signal when the brightness difference is greater than the second threshold value; and reducing the slew rate of the first analog signal by a fixed slew time to generate the second analog signal when the brightness difference is less than the second threshold value.

* * * * *